US005183487A

United States Patent [19]

Lodico et al.

[11] Patent Number: 5,183,487

[45] Date of Patent: Feb. 2, 1993

[54] TRASH HANDLING APPARATUS FOR A SELF-CLEANING ROTARY SCREEN

[75] Inventors: James I. Lodico, Hampton; David R. Coder, East Moline; Lawrence J. Adams, Geneseo; Rebecca A. F. Guthrie, Coal Valley, all of Ill.; Raymond M. Andes, Jr., Bettendorf, Iowa; Philip G. Alexander, Geneseo, Ill.

[73] Assignee: Deere & Company, Moline, Ill.

[21] Appl. No.: 874,287

[22] Filed: Apr. 24, 1992

[51] Int. Cl.[5] ..... B01D 46/04

[52] U.S. Cl. ..... 55/289; 55/290

[58] Field of Search ..... 55/282, 289, 280, 291, 55/400

[56] References Cited

U.S. PATENT DOCUMENTS

| | | | |
|---|---|---|---|
| 4,233,040 | 11/1980 | Vogelaar et al. | 22/269 |
| 4,443,236 | 4/1984 | Peiler | 55/269 |
| 4,906,262 | 3/1990 | Nelson et al. | 55/290 |

*Primary Examiner*—Charles Hart

[57] ABSTRACT

A trash handling apparatus for a self-cleaning rotary screen comprising two cutterbars that extend across the diameter of a circular screen and a comb having a castellated edge is secured to the leading edge of a vacuum chamber. The two cutterbars are provided with outwardly extending ribs that act in concert with notches formed in castellated edge of the comb to scissor large crop material trapped on the rotary screen as it passes the stationary vacuum chamber.

14 Claims, 4 Drawing Sheets

TRASH HANDLING APPARATUS FOR A SELF-CLEANING ROTARY SCREEN

BACKGROUND OF THE INVENTION

1. Field of the Invention

The invention is directed to a trash handling apparatus for a self-cleaning rotary screen.

2. Description of the Prior Art

In recent years it has become common practice to enclose the internal combustion engines of large self-propelled agricultural combines. Typically these enclosures are provided with self-cleaning rotary screens through which a cooling air stream is drawn. Heat exchangers are located behind the screen and include the radiator for cooling the engine, the oil cooler, and the condenser coils for the air conditioning. The screen is used to remove chaff, leaves and other large particulate matter from the cooling air stream so they do not block the various heat exchangers located behind the screen.

It is desirable that the screen be automatically and continuously self cleaning to facilitate air flow through the screen. One method of accomplishing this task is to rotate the screen through a stationary chamber which is used to vacuum the trash accumulated on the screen. This stationary chamber may be pneumatically coupled to the clean air stream downstream of the heat exchanger for reintroducing the trash collected off the screen into the air stream. In another design, the screen is held stationary and the vacuum chamber is rotated about the screen.

Sometimes, corn leaves plug the leading edge of the vacuum chamber. Corn leaves may also plug the chamber itself. These leaves become lodged in the elbow of the chamber. The long corn leaves do not break down, causing a bridging effect across the duct allowing additional leaves to build up behind it.

SUMMARY

It is the main object of the present invention to provide a trash handling apparatus which breaks the corn leaves into smaller pieces so they can be more easily handled by a self-cleaning rotary screen. It is a feature of the present invention that the trash handling apparatus includes a plastic cutterbar having outwardly extending the ribs that act in concert with a comb for scissoring the leaves and breaking them into smaller pieces.

The self-cleaning rotary screen of the present invention is similar to the one disclosed in U.S. Pat. No. 4,906,262, which is incorporated herein by reference. A trash handling apparatus has been added to this self-cleaning rotary screen to better handle corn leaves and other large particulate matter. The trash handling apparatus comprises two radially extending cutterbars having outwardly extending ribs that extend across the diameter of the rotary screen; and a comb mounted to the leading edge of the chamber having a castellated edge with a series of notches that cooperate with outwardly extending ribs of the cutterbar. As the screen is rotated relative to the vacuum chamber, the ribs and the castellated edge of the comb form a series of scissors that break the corn leaves into smaller pieces.

DETAILED DESCRIPTION

Figure 1:
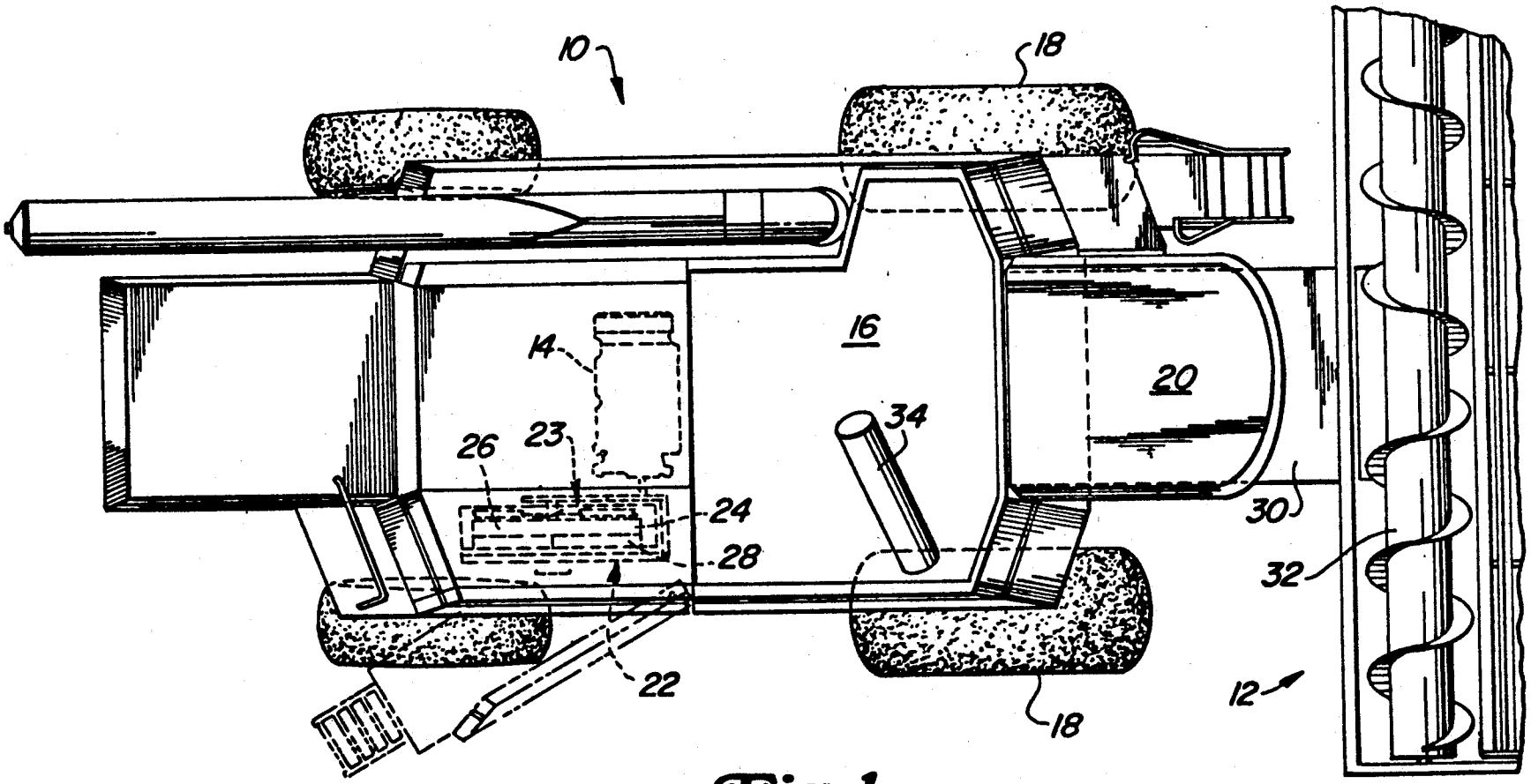
FIG. 1 is an overhead view of an agricultural combine illustrating the location of the engine and the position of the rotary screen.

FIG. 1 illustrates a self-propelled agricultural combine 10 having a harvesting platform 12. The combine is provided with an engine or propulsion means 14 located behind the clean grain tanks 16. The propulsion means provides power to a conventional threshing, separating and cleaning means located inside the combine, the harvesting platform 12 and the ground engaging wheels 18. An operator, in operator cab 20, controls the operation of the combine. Cooling air for the engine is drawn through rotary screen assembly 22 by fan 23 past heat exchangers 24, 26 and 28. These heat exchangers comprise the radiator for cooling the engine, the oil cooler and the condenser coils for the air conditioning.

The agricultural combine first harvests the crop by harvesting platform 12. This platform directs the harvested crop to feederhouse 30 by augers 32. The crop is taken by the feederhouse and directed to the threshing, separating and cleaning means which first removes the grain from the other crop material (threshing). Next, grain is further separated from the remaining crop material (separating). The grain is then cleaned to remove chaff and other crop debris from the grain (cleaning). The clean grain is then directed by auger 34 to clean grain tank 16.

Figure 2:
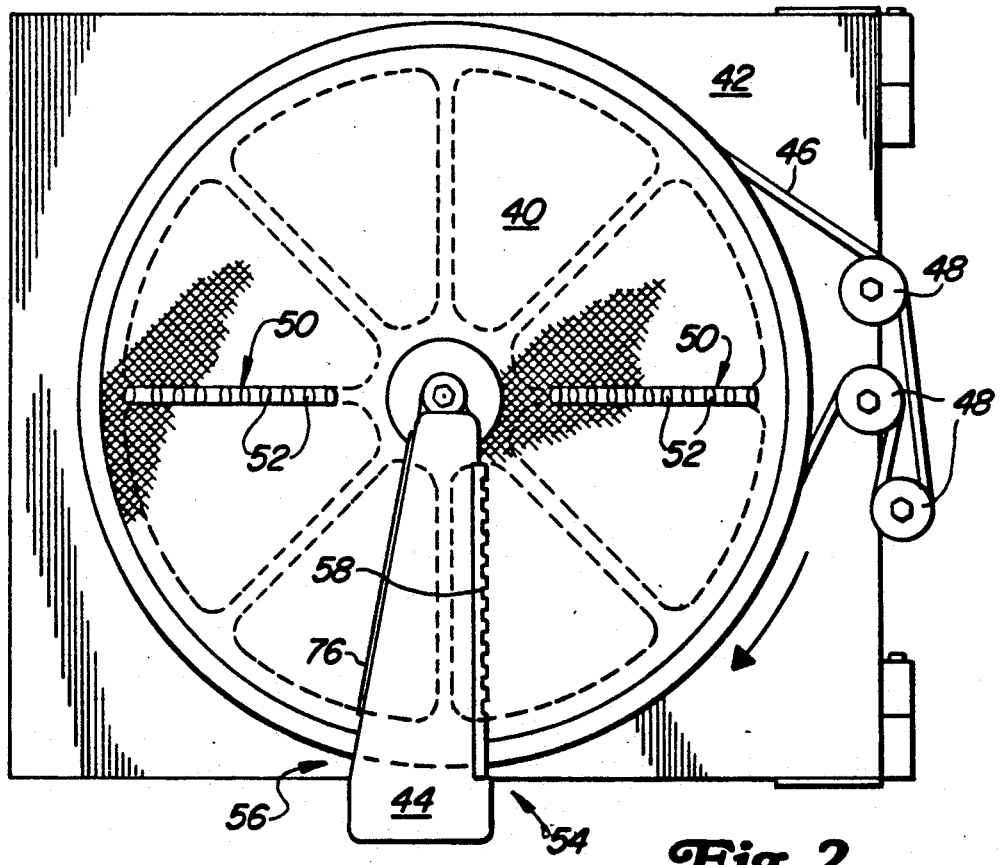
FIG. 2 is a frontal view of the rotary screen and trash handling apparatus.
Figure 3:
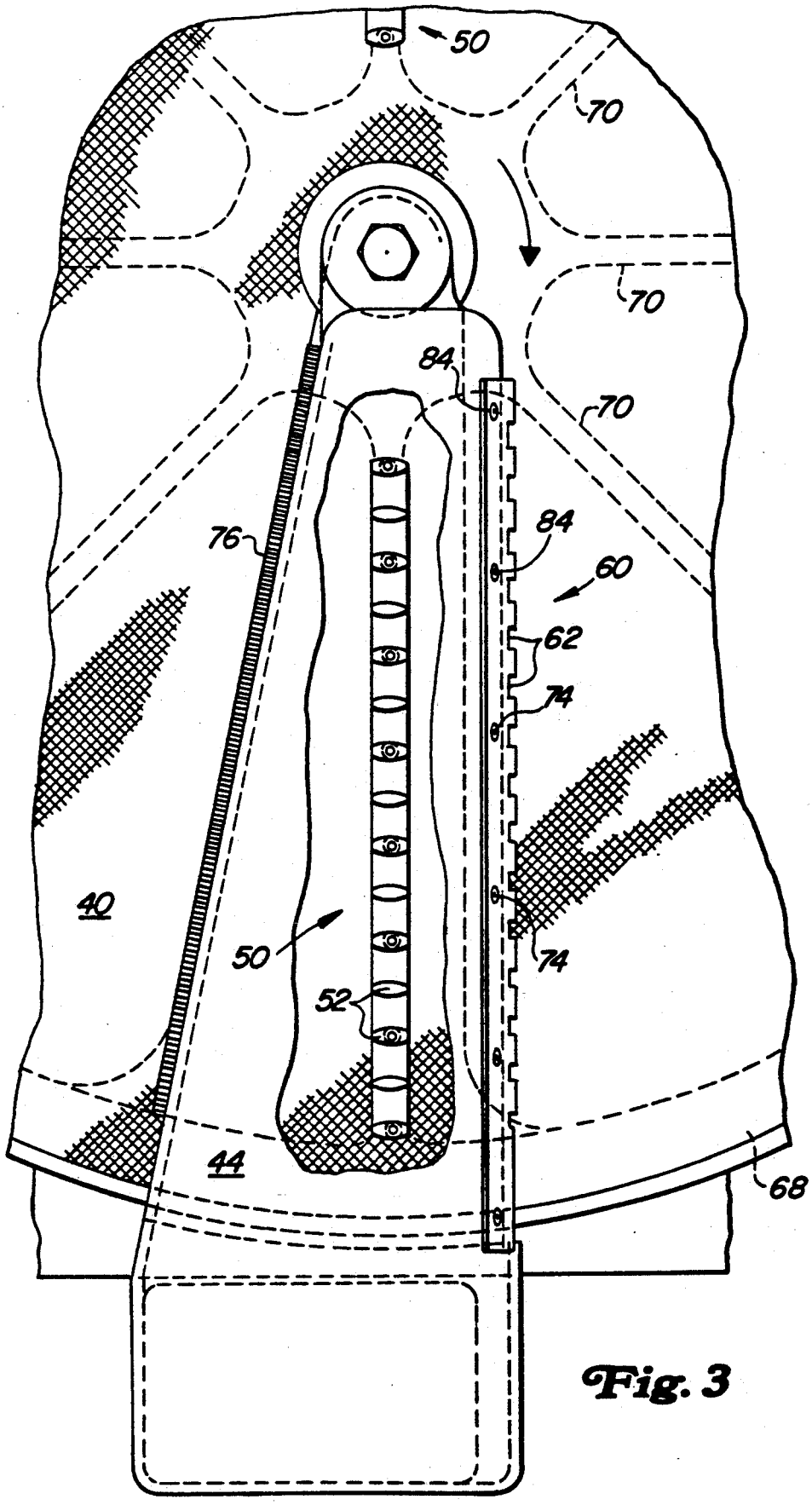
FIG. 3 is a enlarged frontal view of the rotary screen and trash handling apparatus having a cutaway portion in the vacuum chamber.
Figure 4:
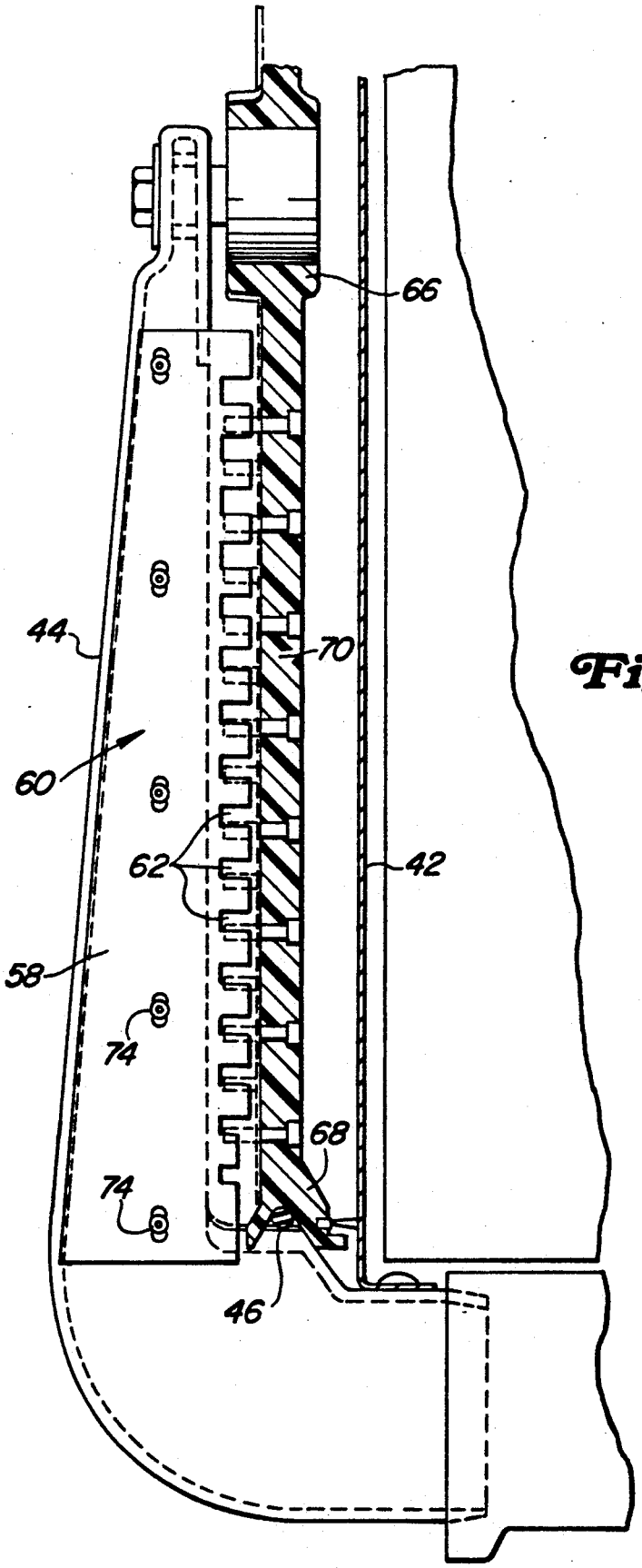
FIG. 4 is a side view of the rotary screen and trash handling apparatus.

FIGS. 2, 3 and 4 better illustrate the trash handling apparatus to which the subject patent application is directed. The self-cleaning rotary screen comprises a circular planar screen 40 which is rotatively coupled to frame 42. A stationary vacuum chamber 44 is also mounted to frame 42 for vacuum debris from the screen. A belt 46 and pulleys 48 form a means for rotating the screen relative to the stationary vacuum chamber. Although the illustrated embodiment shows the screen being rotated, the means for rotating could also rotate the vacuum duct relative to a stationary screen.

The trash handling apparatus comprises two radially extending cutterbars 50 having outwardly extending ribs 52 that are mounted to the screen and extend across the diameter of the screen. As shown in FIG. 2, the cutterbars bisect the circular screen and extend from the outer periphery of the circular screen through its center. The vacuum duct is provided with a leading edge 54 and a trailing edge 56. A comb 58 having a castellated edge 60 is mounted to the leading edge of the vacuum chamber. The castellated edge is provided with a series of notches 62 corresponding to the ribs 52 on the cutterbars.

As best illustrated in FIG. 4, when the screen is rotated relative to the vacuum chamber the outwardly extending ribs 52 pass through the notches 62 scissoring any husks or other plant material trapped on the screen.

Thereby breaking this material into smaller pieces that can be handled by the vacuum chamber.

Figure 5:
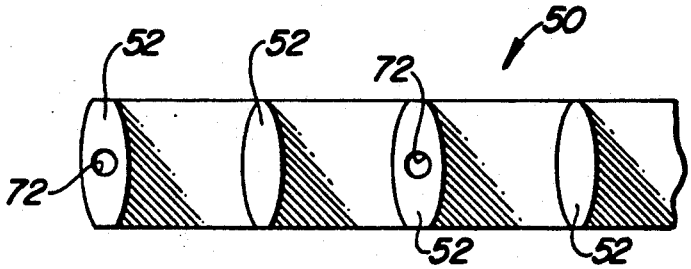
FIG. 5 is a top view of one of the cutterbars.
Figure 6:
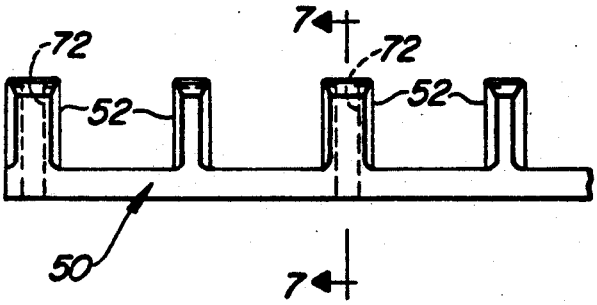
FIG. 6 is a side view of one of the cutterbars.
Figure 7:
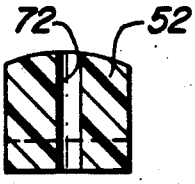
FIG. 7 is a cross sectional view taken along line 7—7.

The planar screen 40 is mounted to a wheel 64 having a hub 66, a rim 68 and radial spokes 70. The outer periphery of the rim is provided with a groove for receiving belt 46. the cutterbars 50 are bolted to opposite radial spokes of the wheel. As illustrated in FIGS. 5–7, some of the outwardly extending ribs 52 are provided with mounting holes 72 for bolting the cutterbars to the radial spokes.

The comb is bolted to the leading edge of the vacuum chamber by bolts 74. The trailing edge of the vacuum chamber is provided with a flexible skirt providing a partial pneumatic seal for the vacuum chamber. The chamber itself extends radially across the screen from the outer perimeter to the center of the circular screen.

The invention should not be limited by the above-described embodiment, but should be limited solely by the claims that follow:

We claim:

1. A self-cleaning filter screen for filtering out large particulate matter from an air stream, said screen comprising:

a planar screen arranged to intercept an air stream so that air to be filtered flows through the screen, the screen having an upstream side and a downstream side;

a cutter bar is mounted to the upstream side of the screen, the cutter bar is provided with a series of outwardly extending ribs;

a chamber is located on the upstream side of the screen for removing material attached to the screen, the chamber is provided with a leading edge and a trailing edge;

a comb is mounted to the leading edge of the chamber, the comb having a castellated edge with a series of notches that correspond to the outwardly extending ribs of the cutter bar; and means for rotating the screen relative to the chamber, whereby large particulate matter located on the screen is scissored by the ribs acting in concert with the notches as the screen is rotated relative to the chamber.

2. A filter screen as defined by claim 1 wherein the chamber is stationary and the filter is rotated by the means for rotating.

3. A filter screen as defined by claim 2 wherein the filter screen is circular having a center and a perimeter, the chamber extends radially across the screen from the perimeter to the center, and the cutter bar extends radially across the screen from the perimeter to the center.

4. A filter screen as defined by claim 3 wherein the screen is rotated so the cutterbar passes beneath the comb before passing into the chamber.

5. A filter screen as defined by claim 4 wherein the chamber is a vacuum chamber for removing material from the screen, trailing edge of the chamber is provided with a flexible skirt providing a partial pneumatic seal for the vacuum chamber.

6. An agricultural combine for harvesting and threshing a crop in a filed, the combine comprising:

a chassis having a ground engaging assembly and an internal combustion engine for driving the combine, the internal combustion engine having a driving sheave;

a filter screen is located adjacent to the internal combustion engine for filtering out large particulate matter from cooling air directed to the internal combustion engine, the screen comprises a planar screen arranged to intercept the cooling air so that air to be filtered flows through the screen, the screen having an upstream side and a downstream side;

a cutter bar is mounted to the upstream side of the screen, the cutter bar is provided with a series of outwardly extending ribs;

a chamber is located on the upstream side of the screen for removing material attached to the screen, the chamber is provided with a leading edge and a trailing edge;

a comb is mounted to the leading edge of the chamber, the comb having a castellated edge with a series of notches that correspond to the outwardly extending ribs of the cutter bar; and a belt is operatively coupled between the driving sheave and the screen for rotating the screen relative to the chamber, whereby large particulate matter located on the screen is scissored by the ribs acting in concert with the notches as the screen is rotated relative to the chamber.

7. An agricultural combine as defined by claim 6 wherein the chamber is stationary and the filter is rotated by the means for rotating.

8. An agricultural combine as defined by claim 7 wherein the filter screen is circular having a center and a perimeter, the chamber extends radially across the screen from the perimeter to the center, and the cutter bar extends radially across the screen from the perimeter to the center.

9. An agricultural combine as defined by claim 8 wherein the screen is rotated so the cutterbar passes beneath the comb before passing into the chamber.

10. An agricultural combine as defined by claim 9 wherein the chamber is a vacuum chamber for removing material from the screen, trailing edge of the chamber is provided with a flexible skirt providing a partial pneumatic seal for the vacuum chamber.

11. A self-cleaning filter screen for filtering out large particulate matter from an air stream, said screen comprising:

a screen arranged to intercept an air stream so that air to be filtered flows through the screen, the screen having an upstream side and a downstream side;

a cutter bar is mounted to the upstream side of the screen, the cutter bar is provided with a series of outwardly extending ribs;

a comb having a castellated edge with a series of notches that correspond to the outwardly extending ribs of the cutterbars located adjacent to the screen; and means for rotating the screen relative to the chamber, whereby large particulate matter located on the screen is scissored by the ribs acting in concert with the notches as the screen is rotated relative to the comb.

12. A filter screen as defined by claim 11 wherein the comb is stationary and the filter is rotated by the means for rotating.

13. A filter screen as defined by claim 2 wherein the filter screen is circular having a center and a perimeter, the comb extends radially across the screen from the perimeter to the center, and the cutter bar extends radially across the screen from the perimeter to the center.

14. A filter screen as defined by claim 3 wherein the screen is rotated so the cutterbar passes beneath the comb.

* * * * *

UNITED STATES PATENT AND TRADEMARK OFFICE

CERTIFICATE OF CORRECTION

PATENT NO. : 5,183,487

DATED : 02 February 1993

INVENTOR(S) : James Irwin Lodico et al.

It is certified that error appears in the above-identified patent and that said Letters Patent is hereby corrected as shown below:

Column 3, line 60 delete "filed" and insert "field".

Signed and Sealed this

Seventh Day of December, 1993

Bruce Lehman

*Attest:*

BRUCE LEHMAN

*Attesting Officer*

*Commissioner of Patents and Trademarks*